United States Patent [19]

Wassilieff

[11] Patent Number: 4,782,965

[45] Date of Patent: Nov. 8, 1988

[54] CHILDPROOF CLOSURE SYSTEM

[76] Inventor: Victor Wassilieff, 84, rue de l'Assomption F-75016, Paris, France

[21] Appl. No.: 6,669

[22] PCT Filed: May 13, 1986

[86] PCT No.: PCT/EP86/00279

§ 371 Date: Jan. 16, 1987

§ 102(e) Date: Jan. 16, 1987

[87] PCT Pub. No.: WO86/07035

PCT Pub. Date: Dec. 4, 1986

[30] Foreign Application Priority Data

May 18, 1985 [DE] Fed. Rep. of Germany ..... 3517926

[51] Int. Cl.[4] ..... B65D 55/02

[52] U.S. Cl. ..... 215/220; 215/253

[58] Field of Search ..... 215/220, 219, 218, 217

[56] References Cited

U.S. PATENT DOCUMENTS

| | | | |
|---|---|---|---|
| 3,944,102 | 3/1976 | Grau | 215/217 X |
| 4,037,747 | 7/1977 | Acton et al. | 215/219 |
| 4,314,656 | 2/1982 | Kessler | 222/153 |
| 4,570,809 | 2/1986 | Archer | 215/220 |
| 4,624,377 | 11/1986 | Wassilieff | 215/220 |

FOREIGN PATENT DOCUMENTS 2137599 10/1984 United Kingdom .

*Primary Examiner*—Stephen Marcus
*Assistant Examiner*—Nova Stucker
*Attorney, Agent, or Firm*—Gilbert L. Wells

[57] ABSTRACT

A child-proof container closure, in particular for bottles, with a threaded inner cap and with an opposite, axially displaceable outer cap, a coupling with at least one elastically flexible coupling element being provided between these caps. The container has the following features:

(a) a crown of elastic coupling elements in the form of spring tabs mounted on the cover plate of the outer or of the inner cap;

(b) the spring tabs extend obliquely to the plane of the cover plate of one of the caps and toward an annular support at the other cap;

(c) in such a manner, that (c1) upon rotation of the outer cap in the direction of screwing tight, the inner cap is dragged along by the spring tabs, (c2) upon reaching a torque larger than that required to screw tight and of which the magnitude is predetermined by the shapes, sizes and materials of the spring tabs, and of the support, the tips of the tabs will slip on the support;

(c3) upon rotation of the outer cap in the direction of unscrewing and while applying an axial force directed from the outer cap onto the inner cap, the spring tabs are bent elastically against the cover plate of the cap on which they are located, the free ends of these tabs resting on the support and the inner cap being dragged along by the spring tabs; and (c4) upon rotation of the outer cap in the direction of unscrewing and in the absence of an axial force directed from the outer cap onto the inner cap, the outer cap shall freely rotate relative to the spring tabs.

4 Claims, 7 Drawing Sheets

FIG. 9
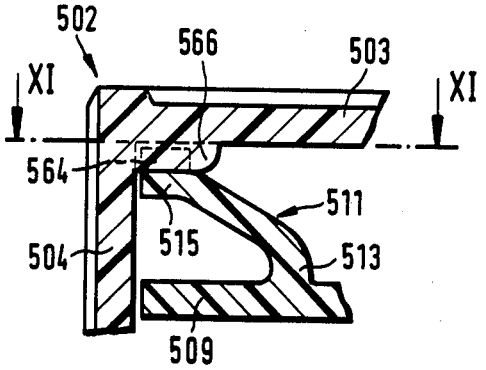
FIG. 10
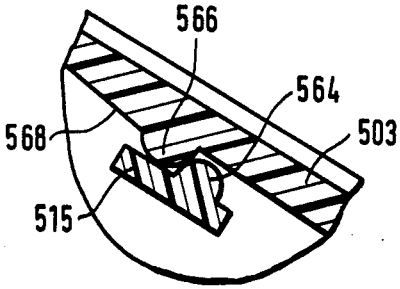
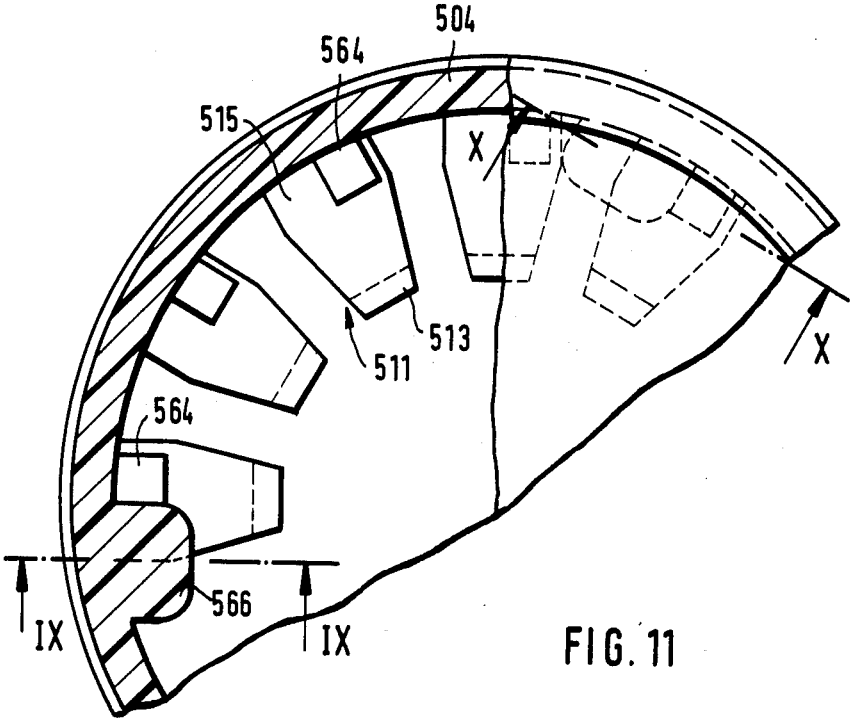
FIG. 11

CHILDPROOF CLOSURE SYSTEM

BACKGROUND OF THE INVENTION

West Germany Published Application No. 3,315,548 discloses a childproof closure for containers, in particular bottles with a threaded inside cap and an outside cap which is axially displaceable relative to the inside cap, a crown of elastic tongues being located at the cover plate of one of the caps, and where the elastic tongues are oblique relative to the plane of the cover plate.

In this known closure, both when closing and opening, both a torque and an axial force directed toward the mouth must be exerted. For that purpose a coupling is provided between a threaded inner cap and an outer cap, comprising at least one elastically flexible element which is inactive in the rest position and is deformed only when subject to an axial force directed from the outer cap toward the threaded cap. In the process there is enough friction between the two caps so that the outer caps can drag along the inner one. As shown by FIGS. 8 or 9 of West German Published Application No. 3,315,548 the coupling element may be a hollow frustrum of a cone present at the inner cap and directed toward the annular corner between the surface and the cover plate of the outer cap. When the outer cap is pressed against the inner cap, the frustoconical membrane is bent against the cover plate of the inner cap and is clamped against the annular projection or the inside wall of the inner cap surface, whereby a torque then may be applied from the outer cap to the inner one.

In the rest position, the elastic membrane ensures that the cover plates of the inner and outer caps are pushed apart so that the outer cap can freely rotate relative to the inner one.

In every case, the elastic membrane is so deformed by an axial force exerted by the outer cap on the inner one that a friction lock takes place which is adequate to drag along the inner cap in either direction of screwing. Accordingly the outer cap must be foced axially against the inner cap both when opening the container (which is required for child safety) but also when tightening it, which is irrelevant to child safety while however demanding special procedures in sealing machines.

SUMMARY OF THE INVENTION

The object of the present invention is to create a childproof closure allowing opening by screwing only when exerting an axial force just as in the above cited prior application but not requiring an axial force when screwing the closure tight.

This object is achieved by a childproof container closure, in particular for bottles, with a threaded inner cap and with an opposite, axially displaceable outer cap, a coupling with at least one elastically flexible coupling element being provided between these caps, characterized by the following features:

(a) a crown of elastic coupling elements in the form of spring tabs mounted on the cover plate of the outer or of the inner cap;

(b) the spring tabs extend obliquely to the plane of the cover plate of one of the caps and toward an annular support at the other cap;

(c) in such a manner, that (c1) upon rotation of the outer cap in the direction of screwing tight, the inner cap is dragged along by the spring tabs, (c2) upon reaching a torque larger than that required to screw tight and of which the magnitude is predetermined by the shapes, sizes and materials of the spring tabs, and of the support, the tips of the tabs will slip on the support;

(c3) upon rotation of the outer cap in the direction of unscrewing and while applying an axial force directed from the outer cap onto the inner cap, the spring tabs are bent elastically against the cover plate of the cap on which they are located, the free ends of these tabs resting on the support and the inner cap being dragged along by the spring tabs; and (c4) upon rotation of the outer cap in the direction of unscrewing and in the absence of an axial force directed from the outer cap onto the inner cap, the outer cap shall freely rotate relative to the spring tabs.

According to feature (a) the elastic coupling elements assume the shape of spring tabs. These may be made integral by plastic injection molding with the associated cover plate of one of the caps.

According to feature (b), the spring tabs slant relative to the plane of the cover plate to which they are attached and extend toward an annular support at the other cap. This annular support may be the inside surface of the other cap or a special ring or annular bead provided at the other cap.

The closure of the present invention allows four operational modes (features c1 through c4):

c1: when rotating the outer cap in the direction of tightening, the inner cap is dragged along by the tabs regardless of an axial force being applied or not; this operation is essential relative to sealing by sealing machines;

c2: when reaching a given torque which exceeds that required to screw tight, the tips of the spring tabs begin to slip on the support, whereby further tightening of the inner cap and hence its destruction is prevented; the magnitude of this torque is determined by the shape and dimensions of the tabs and by the coefficients of friction of the materials used;

c3: the user who is older than a child can open the closure only by forcing axially the outer cap against the inner cap and rotating in the opening direction; thereby the elastic tabs will be bent and will rest by their free tips on the support; the inner cap then can be screwed off due to the friction torque produced between the spring tab tips and the support; and c4: when a small child fails to exert the axial force, but instead only rotates the outer cap, the closure cannot be taken off because the tips of the spring tabs only move along the support, without dragging the inner cap along.

In one embodiment both caps are held near their common axis by cap components so as to be axially displaceable in a limited manner, in particular by means of at least one tubular stub and/or bolt with mutual snap beads.

Those parts which axially restrict and keep the outer cap at the inner one can be so mounted that they produce only a very slight friction torque. As a result, there is no longer a danger that due to this particular friction, these parts restricting the axial displacement in combination with the prestressed spring tabs shall cause the inner cap to be dragged along by the outer one in the direction of opening. Thereby it is impossible to screw the closure open in the absence of an applied axial force.

In another embodiment the spring tabs extend at least over part of their lengths obliquely to axial-radial planes in such a manner that upon rotation of the outer cap in the direction of screwing tight they will press against the support.

As stated it is made possible that a friction torque transmitted from the outer to the inner cap be larger in the direction of tightening than of opening: this is important on the one hand as regards closing, while on the other hand it makes opening impossible to small children.

In yet another embodiment, the closure has the following features:

(a) the support is circular-cylindrical, in particular as regards the shape of the inner wall of one of the caps; and (b) the free tips of the spring tabs when seen axially are circular-cylindrical surfaces, in particular of the same radius of curvature as the inner wall.

The support and the free ends of the spring tabs may assume a circular-cylindrical shape.

In still another embodiment:

(a) the support is circular-cylindrical, in particular at the inner wall of one of the caps;

(b) drive dogs in the forms of bosses are present at the inner wall; and (c) those sides of the spring tabs that come first into contact with the drive dogs when rotating the outer cap in the direction of screwing-off are radially shortened.

Drive dogs may be provided at one cap which cooperate with the free tips of the spring tabs and transmit a high torque in the direction of tightening while in the opening direction, these drive dogs will jump over the tip of the spring tabs without transmitting a significant torque.

In a further embodiment, the drive dogs for the spring tab tips are present on one cap and that the spring tabs are directed at least approximately radially (FIGS. 11, 13, 15).

As stated in the further embodiment, the spring tabs may be directed radially and drive dogs may be provided to drag along the inner cap, where these drive dogs cooperate with the free tips of the spring tabs. In this case the inner cap is carried along by the engagement of the spring tabs and drive dogs, not by pressing or clamping the spring tabs.

According to a still further embodiment, the drive dogs may assume a variety of shapes, for instance apertures or recesses, and according to yet another embodiment, they have only one oblique recess acting in the direction of rotation, while in another embodiment they have bosses on the cover plate.

Lastly, in a further embodiment the drive dogs may merge at one of their sides by inclines into the adjacent part of a surface or a cover plate. The inclines act as ramps for the free tips of the spring tabs or projections mounted thereto. When turning in the opening direction without applying an axial force, the tips of the spring tabs therefore shall jump over the drive dogs without generating a significant torque.

DESCRIPTION OF THE DRAWINGS

Illustrative embodiments and embodiment modes with further features are described below in relation to the drawings:

FIG. 9 is a partial axial section in a plane IX—IX of FIG. 11 of part of a fifth embodiment mode;

FIG. 10 is a section in plane X—X of FIG. 11 of a further detail of this embodiment mode;

Figure 12:
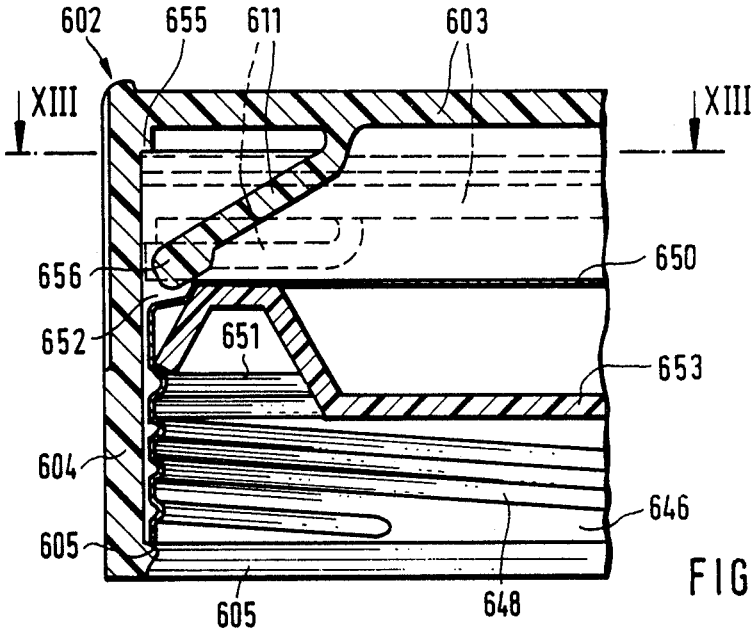
Figure 13:
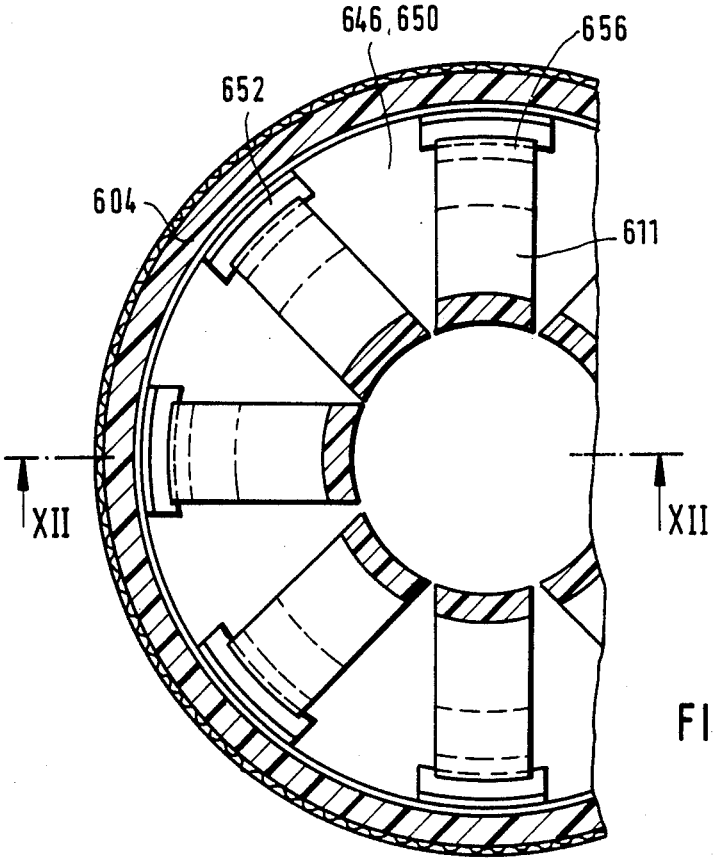
Figure 14:
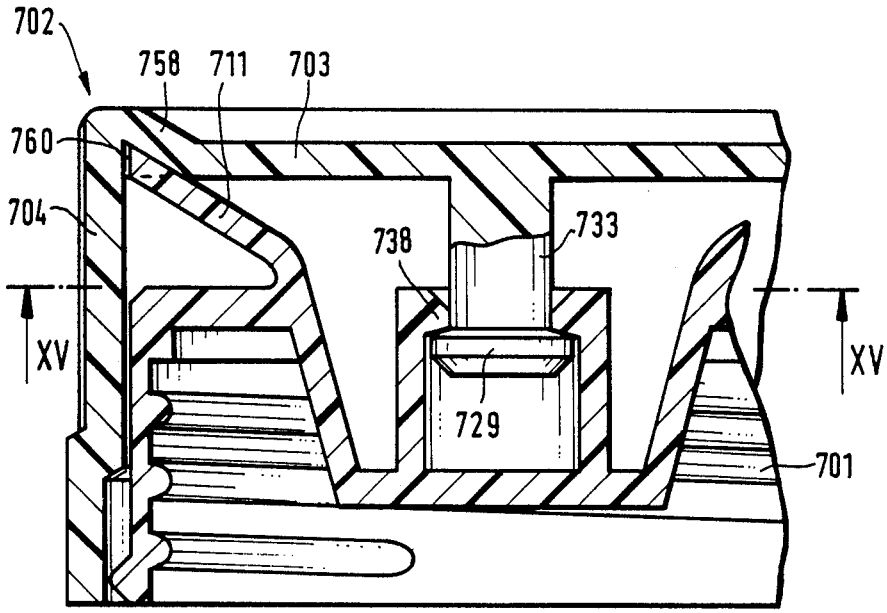
Figure 15:
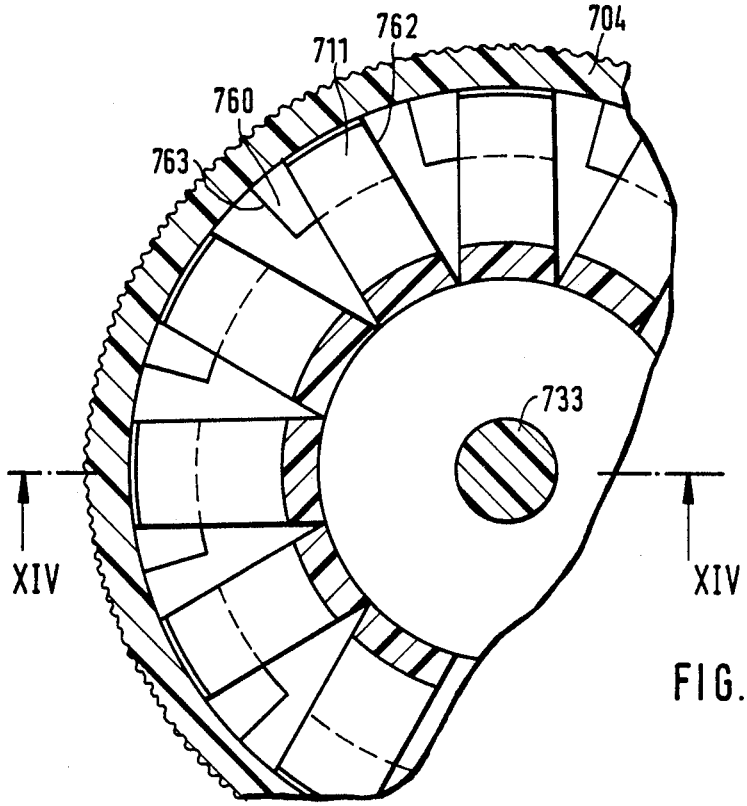

Fiqure 11 is a partial axial section in the plane XI—XI of FIG. 9;

FIG. 12 is a partial radial section in a plane XII—XII in FIG. 13 through the caps of a sixth embodiment mode;

FIG. 13 is a cross-section in the plane XIII—XIII of FIG. 12;

FIG. 14 is an axial section thrugh the caps of a seventh embodiment mode in the plane XIV—XIV of FIG. 15; and FIG. 15 is a cross-section in the plane XV—XV of FIG. 14.

DESCRIPTION OF THE PREFERRED EMBODIMENTS

First Embodiment

Figure 1:
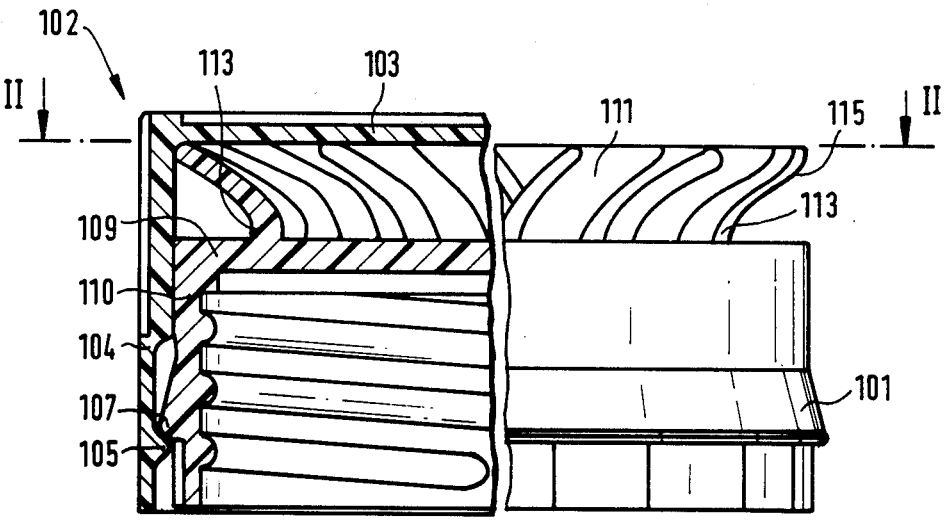
FIG. 1 shows an inner cap first embodiment mode of the invention in side view and on the right, and on the left, the inner and the outer caps in section along a radial plane 1 of FIG. 2.
Figure 2:
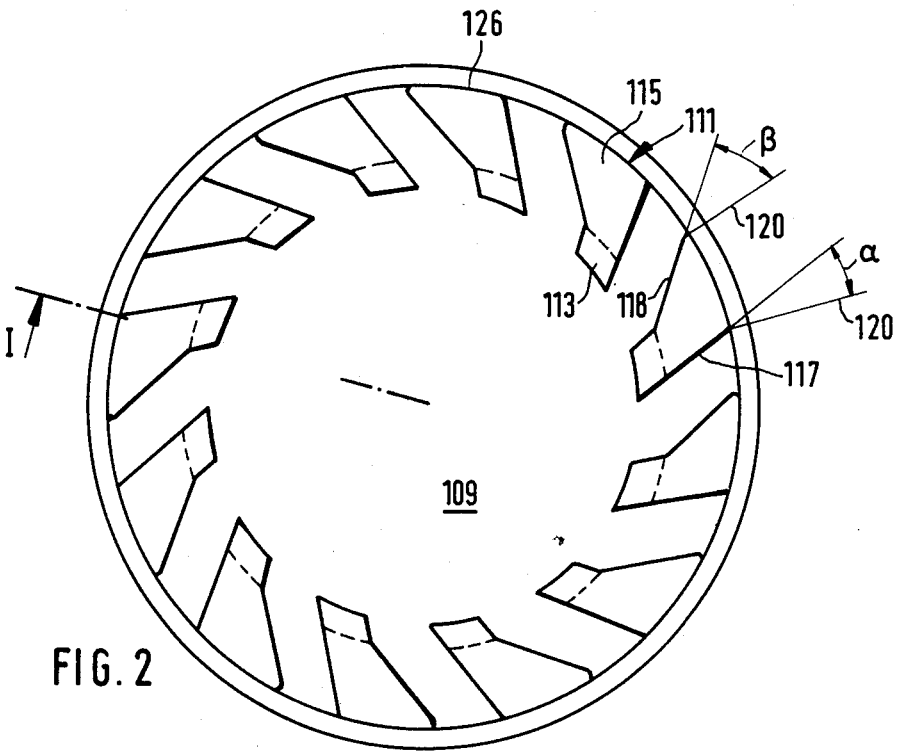
FIG. 2 is a topview of the inner cap from a plane II—II in FIG. 1.

As shown by FIGS. 1 and 2, there are an inner cap 101 with inside thread and an outer cap 102. The outer cap is provided with a cover plate 103 and a shell 104. The outer cap can be slipped over the inner cap and is held fast against loss by an annular inner bead 105 underneath an annular outer bead 107 of the inner cap.

A crown of elastic coupling elements in the form of spring tabs 111 is provided at the cover plate 109 of the inner cap. These spring tabs are integrally injection-molded of an elastic plastic with the inner cap. The base 113 of each spring tab projects roughly perpendicularly from the cover plate 109. Each spring tab furthermore curves outwardly beyond, the outer segment 115 of each tab being approximately plane and extending at an angle of about 45° upward and outward. Seen in the circumferential direction, the spring tabs are narrowest at their base 113. They become wider as seen in the circumferential direction. Seen from above (FIG. 2), their two edges 117 and 118 of radii 120 subtend different acute angles. The angle alpha of the clockwise front edge 117 opposite the associated radius 120, when measured at the outer edge 126 of the tabs when these are in their rest position and in a plane parallel to the cover plate 109, is less than the angle beta subtended by the clockwise rear edge 118 and the associated radius 120. Alpha illustratively may be 25°, beta 35°.

The outer cap 102 is so joined to the inner cap 101 by the beads 105 and 107 that the spring tabs 111 are slightly stressed. Such a stress need only be enough for the free tips of the tabs to be just being dragged along by the outer cap at the beginning of tightening. In the rest position therefore the friction torque transmitted between tabs and outer cap must exceed the initial resistance to tightening exerted by the thread orifice on the inner cap.

During tightening, the free tips of the spring tabs are dragged along some way in the clockwise direction. In this process they further bend into the radial direction, resting on the outer cap shell 104 and thereby clamp the inner cap relative to the outer cap, whereby the inner cap is dragged along in the direction of tightening. The torque transmitted by the outer cap spring tabs to the inner cap increases as the resistance to the screwing motion offered by the inner cap rises. When a predetermined maximum torque is reached, the tabs 111 begin to slip along the inside wall of the outer caps 102, so that when sealing machines are used, overloading or destroying the caps will be prevented when they are being screwed tight. No axial force is required for tightening.

If on the other hand (in the absence of an axial force), the outer cap is rotated counter-clockwise, then it will slip on the outer tips of the tabs while the inner cap remains stationary. Only after an axial force has been exerted on the outer cap and on the spring tabs will these tabs deform outward. Whereas in the above case a deformation in the circumferential direction was involved, here only a deformation from top to bottom (i.e., parallel to the axis) takes place. As a result, the tabs again are stressed relative to the shell 104 and friction locking takes place whereby, if the axial force is sufficient, the inner cap is dragged along by the outer cap in the counter-clockwise direction, that is, in the opening direction.

Second Embodiment

Figure 5:
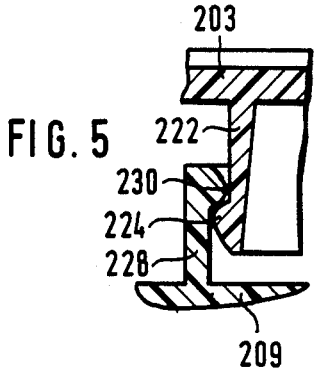
FIG. 5 is a partial axial section of the mounting of the outer cap to the inner cap for the same embodiment (these parts cannot be seen in FIG. 3)
Figure 4:
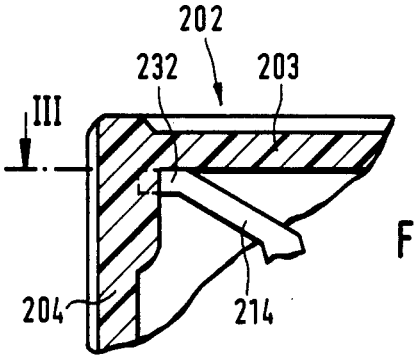
FIG. 4 is a partial axial section along line IV—IV of FIG. 3.
Figure 3:
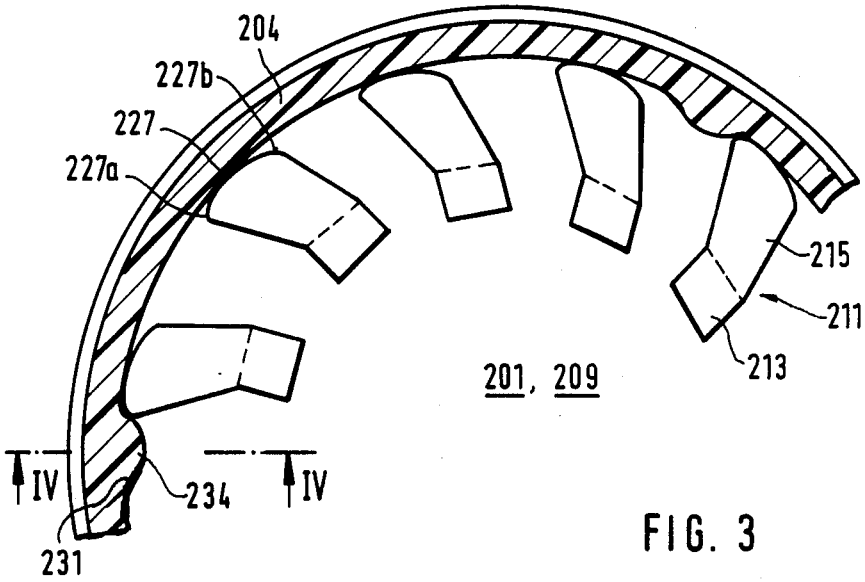
FIG. 3 relates to another embodiment mode and shows a cross-section in a plane III in FIG. 4 of the outer cap and a topview of the inner cap.

In the embodiment mode shown in FIGS. 3 through 5, the cap and overcap again are connected in loss-proof manner. However, this feature now is provided not by snap-in beads such as 105 and 107 in FIG. 1, but by a tubular stub 222, fitted with an outer bead 224, at the outer cap cover plate 203 and also by a tubular bead 228 having an inner bead 230 at the inner cap cover plate 209. When first plugging together the two caps, the beads engage behind each other and keep together the two caps with axial play and in undetachable manner. This fastening system introduces only a negligibly small friction torque, even in the presence of significant prestressing of the spring tabs. As a result, the inner cap can be unscrewed only if an axial force is applied.

The cover plate 209 of the inner cap 201 is provided with spring tabs 211 which each have a base 213 and a center segment 214 which again is directed upward and outward. Each tab 211 has a tip 232 (FIG. 4) extending radially outward, that is parallel to the cover plate 203 of the outer cap 202. The tip is provided as shown by FIG. 3 from above with an edge 227 of approximate spiral shape. This edge by its most advanced end **227*a* touches the inner wall of the outer cap shell 204 while being farther at its end 227*b*** from this inner wall.

In contrast to the first embodiment, the outer cap shell 204 is equipped with inwardly projecting drive dogs 234 shaped like beaded bosses of substantially circular-cylindrical cross-sections but merging through an incline 231 into the inner wall. The incline subtends an acute angle with a tangent to the cylindrical inner wall.

When screwing tight, the drive dogs 234 reliable assure that three of the spring tabs 211 are carried along and become stressed relative to the outer cap shell 204. Simultaneously all other tabs are stressed and assure transmission of the torque required to tighten. The moment a predetermined torque is exceeded, namely once the inner cap is screwed on tight, the spring tabs will slip on the shell 204 and jump over the drive dogs 234. The resultant noise then indicates acoustically that the tightening process is completed.

To screw off the inner cap, again an axial force must be applied in the same manner as for the first embodiment.

If an attempt is made to unscrew in the absence of an axial force, the ends **227*b* of the tab edges will move onto the inclines 231 which make it possible for the tabs to jump over the drive dogs 234** without thereby transmitting a significant torque. As a result the inner cap cannot be dragged along, that is, it cannot come off.

Third Embodiment

Figure 6:
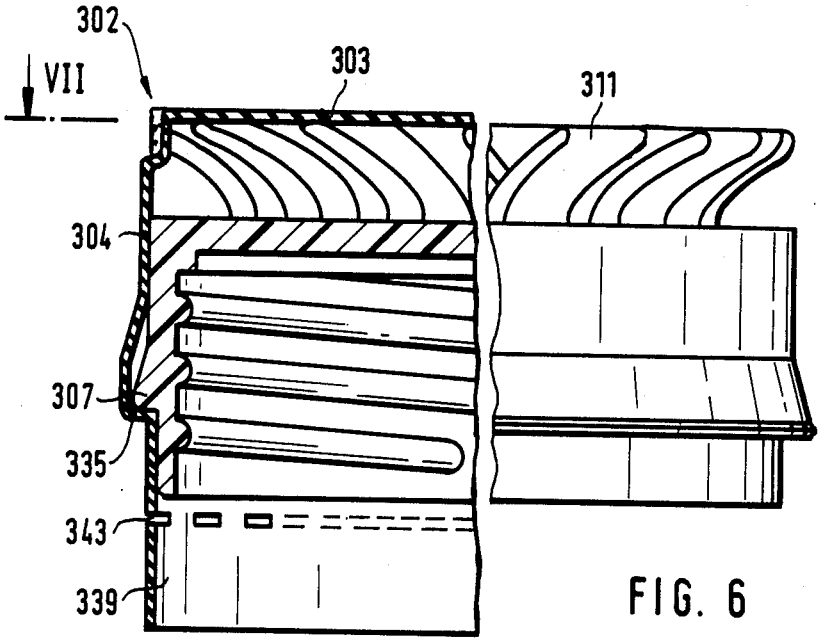
FIG. 6 is a third embodiment mode, with a sideview of the inner cap on the right and on the left and shows in axial sections the inner and outer caps in a plane VI in FIG. 7.
Figure 7:
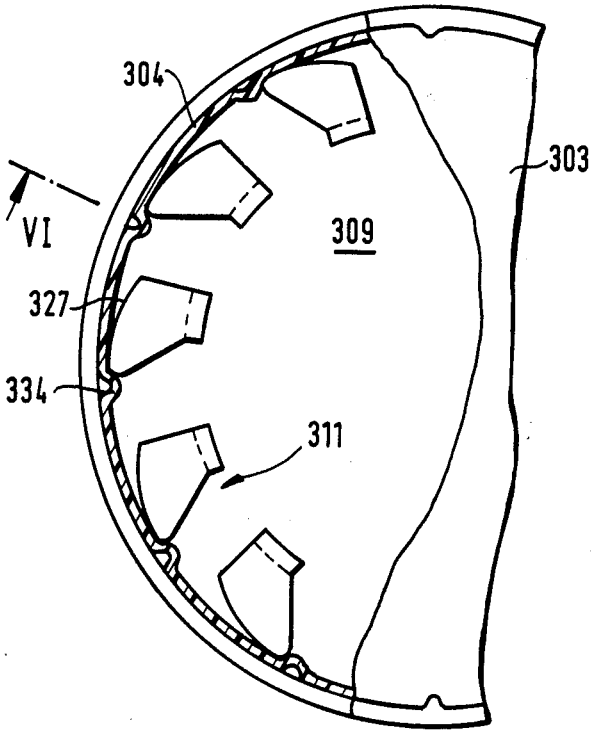
FIG. 7 is a partial cross-section in the plane VII of FIG. 6.

In the third embodiment mode shown in FIGS. 6 and 7, the outer cap 302 is made of metal. It comprises at its bottom a tear-off, anti-tamper safety ring 339. By means of an inner shoulder 335, this cap 302 engages, with play, an outer bead 307 of the inner cap so that both caps are held together undetachably. The spring tabs 311 have a design similar to that of the second embodiment. The outer cap shell 304 comprises drive dogs 334 adjoining its cover plate 303 which assume the shape of trough-like impressions, one for each spring tab. All together, there are twelve tabs and dogs equidistantly distributed over the circumference.

Operation is the same as for the second embodiment mode.

Fourth Embodiment

Figure 8:
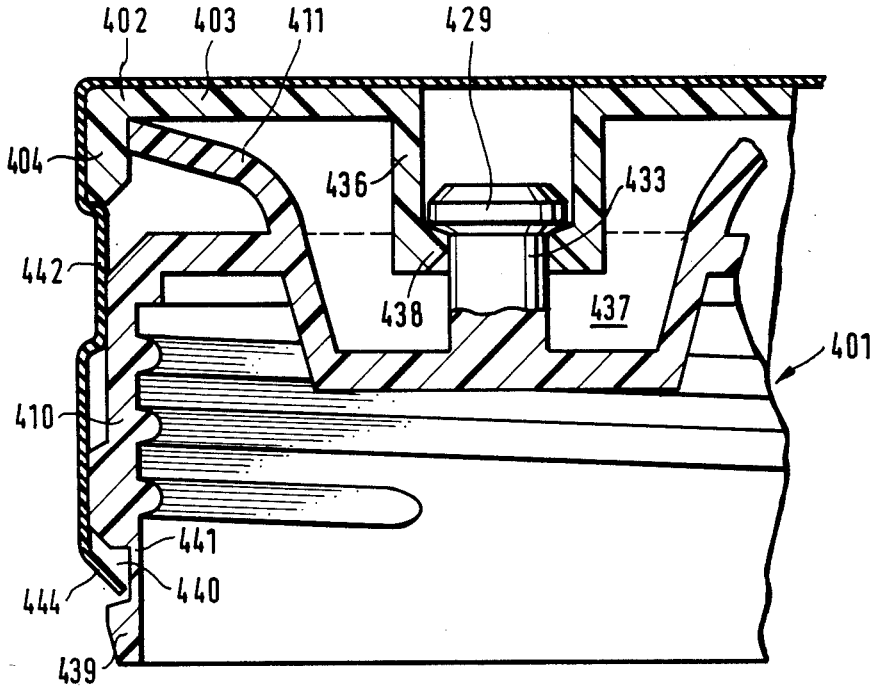
FIG. 8 is an axial section through the caps in a fourth embodiment mode.

In a variation of the first embodiment mode, shown in FIG. 8, the outer cap 402 is provided with only a very short shell 404. The shell 410 of the inner cap 401 is extended in the direction of its open end. At the very bottom it has a tamper-proof safety ring 439 integrally joined by a thin wall part 441 to the remaining part of the inner cap. Prior to use the anti-tampering safety ring can be separated from the shell 410 by tearing that wall part. An annular groove 440 is located outside the wall part 441. A metal over-cap 442 encloses the outer cap 402 and most of the inner cap 401 and rests by its inwardly bend edge 444 on the anti-tampering safety ring 439.

Again the outer cap 402 is held with play by the inner cap 401. The attachment is implemented by an outer cap tubular stub 436 provided with an inner bead 438 and with a bolt 433 projecting from a basin 437 of the inner cap 401 and having a head 429. After the two caps are initially plugged together, the head 429 and the inner bead 438 keep the two caps undetachably together but still axially movable.

This closure together with the over-cap 442 can be screwed tight—which requires only to laterally pivot the spring tabs 411 outward. However opening—which requires axial displacement of the outer cap 402 relative to the inner cap 401—will be prevented by the over-cap 442. Only after the anti-tampering safety ring 439 has been removed will it be possible to displace the outer cap relative to the inner one, the spring tabs 411 then being bent against the inner cap, which is required to produce the necessary friction for unscrewing.

Fifth Embodiment

In a fifth embodiment mode shown in FIGS. 9 through 11, the tips 515 of the spring tabs 511 again point parallel to the outer cap cover plate 503. In this design the tips are provided with a unilateral boss 564 of half-cylindrical shape as shown in the radial direction in FIG. 10. Drive dogs 566 in this case are provided at the cover plate 503 with which they are integral. Seen in the radial direction (FIG. 10), these drive dogs also are approximately semicylindrical, but they merge by an incline 568 into the outer cap cover plate 503. Three such drive dogs 566 are located along the circumference.

Operation is similar to that of the second embodiment. When tightening, the drive dogs 566 again reliably cause at least a few of the spring tabs 511 to deform and to rest against the inner wall of the shell 504. This is implemented by the eccentric arrangement of the tab bosses 564. When the highest admissible torque is being reached, that is after the inner cap has been screwed on tight, the drive dogs 566 again (slip) jump over the bosses 564 and the tab tips then slide on the inner wall of the shell 504. Again an axial force must be applied to open, whereby the tabs 511 will be bent against the cover plate 509 and therefore will rest against the inner wall of the shell 504.

Sixth Embodiment

As shown by FIGS. 12 and 13, a metal cap 646 is provided within the outer cap 602 and will be fastened by means of rolled threaded ribs 648 on a container orifice, in particular a bottle mouth. The metal cap rests by its lower edge against an outer cap annular inner bead 605. This metal cap is provided at the top with a rolled corrugation 651 that will hold a cross-sectionally contoured sealing disk 653. Apertures 652 are spread along the circumference of the metal cap. A crown of spring tabs 611 is located on the outer cap cover plate 603 and (in top view) these tabs point radially, each having a thicker tip 656. The positions of the tabs in the rest position are shown in FIG. 12 in solid lines.

When the outer cap 602 is depressed, the spring tabs will deform and assume the shapes shown in dashed lines in FIG. 12. An inward and downwardly projecting annular crown 655 of the outer cap 602 in this position will press against the tab tips 656 so that they reliably enter the apertures 652. Upon rotating the outer cap 602 in any direction, a torque will be exerted on the metal cap 646. If the attempt is made in the absence of an axial force to unscrew the enclosure, the tab tips 656 will revolve without entering the apertures 652.

Seventh Embodiment

In the embodiment of FIGS. 14 and 15, the cover plate 703 of the outer cap 702 is somewhat recessed. It merges by an annular segment 758 into the shell 704. In the annular corner between the cover plate and the outer cap shell there is a crown of recesses 760. These recesses are wedge-shaped or nearly so when seen in the circumferential direction. These recesses are provided at their ends with a stop edge 762 and they are deepest at that location. From there, their depth increases continuously so that each recess, after a circumferential distance somewhat exceeding the width of the spring tabs 711 will end at a line 763. The tabs 711 when seen in topview are directed radially. Their outer tips are a slight distance away in the rest position from the outer cap shell 704, but they are slightly prestressed against the upper surface of the recesses 760 or against an area between these recesses.

During the process of screwing tight, the stop edges 762 will touch the spring tabs 711 which they then drag along. If subsequently, but without applying an axial force, the outer cap is rotated counter-clockwise, then the tabs will snap from one recess 760 to another without thereby dragging along the inner cap. If moreover an axial force is applied on the inner cap, then the spring tabs are clamped in the above described manner between both caps, whereby the inner cap is dragged along against the opening resistance.

I claim:

1. A child-proof seal having an axial-radial plane for containers, in particulr bottles, having a threaded inside cap and an outside cap with an inside wall which is axially displaceable relative to said inside cap, a cover plate having a plane on said inside cap, a crown of spring tabs having free ends located on said cover plate, said tabs oblique relative to said plane of said inside cap, an annular support on the inside of said outside cap, wherein:

(a) said free ends point to said annular support;

(b) said spring tabs having a slant in a circumferential direction relative to said axial-radial plane over at least a portion of their lengths that upon a rotation of the outer cap they brace themselves against said annular support;

(c) so that (c1) said inside cap is carried along by said spring tabs when said outside cap is rotated in a direction of screwing-shut;

(c2) upon reaching a torque exceeding that required for screwing-shut and of an amplitude predetermined by dimensioning and material selection of said spring tabs and of said support, said ends of said spring tabs slip on said support;

(c3) said spring tabs being elastically bent against said cover plate of said inside cap on which they are seated when said outer cap is rotated in an unscrewing direction and an axial force is applied against said inside cap, said free ends resting against said support and said inside cap dragged along by said spring tabs; and (c4) said outside cap rotating freely relative to said spring tabs when said outside cap is rotated in said unscrewing direction in the absence of an axial force exerted by said outside cap on said inside cap.

2. The child-proof seal of claim 1, wherein;

(a) said support is circular-cylindrical, in particular the shape of said inside wall of said outside cap;

(b) drive-means in the shape of slip-over projections are mounted to said inside wall; and (c) said spring tabs have radially shortened sides first coming into contact with said drive means when said outside cap is rotated in said unscrewing direction.

3. The child-proof seal of claim 2 wherein said free ends have edges at least approximately spiral when seen in said axial direction.

4. The child-proof seal of claim 3 wherein said drive means have an inclined surface acting as a ramp at those sides which come first into contact with said spring tabs during said unscrewing operation.

* * * * *